US005976034A

United States Patent [19]

Kato et al.

[11] Patent Number: 5,976,034

[45] Date of Patent: Nov. 2, 1999

[54] MULTI-LAYER STRUCTURED GOLF BALL

[75] Inventors: Akira Kato, Shirakawa; Mikio Yamada, Kobe, both of Japan

[73] Assignee: Sumitomo Rubber Industries, Ltd., Hyogo-ken, Japan

[21] Appl. No.: 08/944,970

[22] Filed: Oct. 7, 1997

[30] Foreign Application Priority Data

Oct. 7, 1996 [JP] Japan ..... 8-265905

[51] Int. Cl.[6] ..... A63B 37/06; A63B 37/12

[52] U.S. Cl. ..... 473/363; 473/365

[58] Field of Search ..... 473/363, 351, 473/364, 357, 359

[56] References Cited

U.S. PATENT DOCUMENTS 5,674,137 10/1997 Maruko et al. ..... 473/351 X
5,716,293 2/1998 Yabuki et al. ..... 473/363

*Primary Examiner*—George J. Marlo

[57] ABSTRACT

A multi-layer structured golf ball having high initial velocity at low head speed region and excellent flight performance, while maintaining the characteristics inherent in conventional thread wound golf balls, i.e. good shot feel, wherein the multi-layer structured golf ball has (a) a solid core having a diameter of 23 to 37 mm, and a deformation amount of 2.5–10 mm with a load of 10 kgf to 130 kgf (b) an intermediate cover having a thickness of 0.5 to 5.0 mm and formed from a thermoplastic resin on the solid core, (c) a thread rubber layer having a thickness of 1.0 to 5.0 mm, formed on the intermediate cover, and (d) an outer cover covering the thread rubber layer, formed from a thermoplastic resin.

4 Claims, 1 Drawing Sheet

MULTI-LAYER STRUCTURED GOLF BALL

FIELD OF THE INVENTION

The present invention relates to a multi-layer structured golf ball. More particularly, it is directed to a multi-layer structured golf ball having a high initial velocity at a low head speed region and excellent flight performance, while maintaining the characteristics inherent in conventional thread wound golf balls i.e. a good shot feel.

BACKGROUND OF THE INVENTION

Many golf balls are commercially selling, but they are typically classified into solid golf balls such as two-piece golf balls, three-piece golf balls and the like, and also thread wound golf balls. The solid golf balls consists of a solid core of molded rubber material and a cover of a thermoplastic resin (e.g. ionomer resin) covering on the solid core. The thread wound golf ball consists of a solid or liquid center, a thread wound layer formed on the center and a cover make of an ionomer resin or balata etc. having a thickness of 1 to 2 mm covering the thread wound layer. The solid golf balls which are selling commercially are mainly two-piece golf balls because they are easy to produce. The two-piece solid golf ball, when compared with the thread wound golf ball, has better durability and better flight performance because of a larger initial velocity when hitting and longer flight distance. The two-piece solid golf ball is generally approved or employed by many golfers, especially amateur golfers. On the other hand, the two-piece solid golf ball has a poor shot feel at the time of hitting and poor controllability on approach shots because of less spin.

Recently, in order to provide a golf ball having good shot feel in addition to excellent flight distance, a golf ball having a multi-layer structure has been proposed. However, the flight distance was degraded in the excessive pursuit of a good shot feel.

OBJECTS OF THE INVENTION

A main object of the present invention is to provide a multi-layer structured golf ball having a high initial velocity at a low head speed region and long flight distance, while maintaining the characteristics inherent in the conventional thread wound golf ball, i.e. good shot feel, to provide a soft impact when hitting.

According to the present invention, the object described above has been accomplished by making the cover layer thicker than conventional golf balls and providing the cover with three layers wherein an intermediate layer which is made of a cushion layer formed from thread rubber is sandwiched between the other two layers formed from a thermoplastic resin, thereby providing a multi-layer structured golf ball having a high initial velocity at a low head speed region, and high initial velocity and good shot feel because the thread rubber layer has high rebound characteristics and acts as a cushion layer which easily deforms when hitting.

This object as well as other objects and advantages of the present invention will become apparent to those skilled in the art from the following description with reference to the accompanying drawings.

SUMMARY OF THE INVENTION

Figure 1:
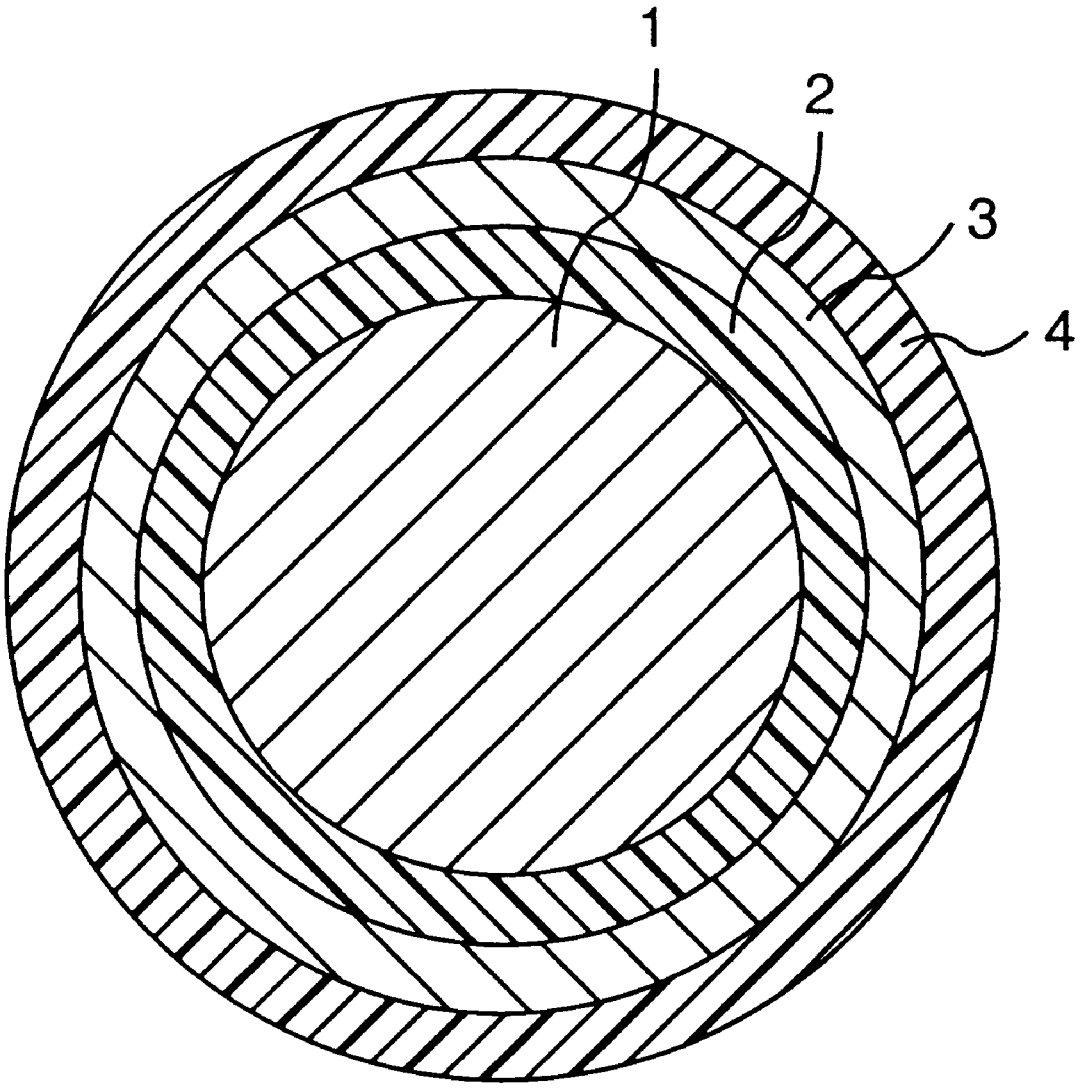
FIG. 1 is a schematic cross section illustrating one embodiment of the golf ball of the present invention.

The present invention provides a multi-layer structured golf ball comprising (a) a solid core having a diameter of 23 to 37 mm, (b) an intermediate cover having a thickness of 0.5 to 5.0 mm and formed from a thermoplastic resin on the solid core, (c) a thread rubber layer having a thickness of 1.0 to 5.0 mm, formed on the intermediate cover, and (d) an outer cover covering the thread rubber layer, formed from a thermoplastic resin.

DETAILED DESCRIPTION OF THE INVENTION

The multi-layer structured golf ball of the present invention will be explained with reference to the accompanying drawing. FIG. 1 is a schematic cross section illustrating one embodiment of the golf ball of the present invention. In FIG. 1, 1 is a solid core, 2 is an intermediate cover, 3 is a thread rubber layer and 4 is an outer cover.

The solid core 1 is obtained by mixing a rubber composition in an internal mixer (a Banbury mixer or a kneader), or a mixing roll to form in a plug having a given size, followed by vulcanizing or press-molding the rubber composition in a mold. The rubber composition typically includes, 100 parts by weight of a base rubber, 10 to 30 parts by weight of a metal salt of a (meth)acrylic acid, 0.3 to 3 parts by weight of a crosslinking agent, optionally a filler and an antioxidant, and the like.

The base rubber may be natural rubber and/or synthetic rubber which has been conventionally used for solid golf balls. Preferred is a high-cis polybutadiene rubber containing a cis-1,4 bond of not less than 40%, preferably not less than 80%. The polybutadiene rubber may be mixed with natural rubber, polyisoprene rubber, styrene-butadiene rubber, ethylene-propylene-diene rubber (EPDM), and the like.

The metal salt of (meth)acrylic acid, which acts as a co-crosslinking agent, includes mono- or di-valent metal salts, such as zinc or magnesium salts of $\alpha,\beta$-unsaturated carboxylic acids having 3 to 8 carbon atoms (e.g. acrylic acid, methacrylic acid, etc.). A preferred co-crosslinking agent is zinc acrylate because it imparts high rebound characteristics to the resulting golf ball. The amount of the metal salt of (meth)acrylic acid in the rubber composition may preferably be 10 to 30 parts by weight, based on 100 parts by weight of the base rubber. When the amount of the metal salt of the (meth)acrylic acid is larger than 30 parts by weight, the core is too hard. Therefore, the shot feel is poor. On the other hand, when the amount of the metal salt of (meth)acrylic acid is smaller than 10 parts by weight, the core is soft. Therefore the rebound characteristics are degraded and the flight distance is reduced.

The crosslinking agents may be an organic peroxide such as dicumyl peroxide, t-butyl peroxide and the like. A preferred organic peroxide is dicumyl peroxide. The amount of the organic peroxide may preferably be from 0.3 to 3.0 parts by weight, based on 100 parts by weight of the base rubber. When the amount of the organic peroxide is smaller than 0.3 parts by weight, the core is too soft. Therefore, the rebound characteristics are degraded and the flight distance is reduced. On the other hand, when the amount of the organic peroxide is larger than 3.0 parts by weight, the core is too hard and shot feel is poor.

The filler, which can be used for the core of the golf ball, includes for example, an inorganic filler such as zinc oxide, barium sulfate, calcium carbonate, and the like), high specific gravity metal powder filler (such as tungsten powder, molybdenum powder, and the like), and the mixture thereof. The amount of the filler is not limited and can vary depending on the specific gravity and size of the cover and core, but is preferably from 5 to 70 parts by weight, based on 100 parts by weight of the base rubber. When the amount of the filler is smaller than 5 parts by weight, the core is too light. Therefore, the resulting golf ball is too light. On the other hand, when the amount of the filler is larger than 70 parts by weight, the core is too heavy and therefore the resulting golf ball is too heavy.

The rubber composition for the core of the present invention can contain other components which have been conventionally used for preparing the core of solid golf balls, such as antioxidant or peptizing agent. If used, the amount of the antioxidant is preferably 0.2 to 1.5 parts by weight based on 100 parts by weight of the base rubber.

In the multi-layer structured golf ball of the present invention, the solid core has a diameter of 23 to 37 mm, preferably 25 to 35 mm. When the diameter of the solid core is smaller than 23 mm, the launch angle at the time of hitting is reduced, the spin amount increases and flight distance reduces. On the other hand, when the diameter of the solid core is larger than 37 mm, the thickness of the thread rubber layer is decreased and the winding of thread rubber wound finish before sufficient tension is applied on the thread rubber. Therefore, the rebound characteristics of the resulting golf ball are degraded. Further, the solid core has a surface hardness in JIS-C hardness of 30 to 85, preferably 40 to 80. The JIS-C hardness is substantially the same as Shore C. When the hardness is smaller than 30, the rebound characteristics are degraded and the flight distance is reduced. When the hardness is larger than 85, the spin amount increases and the flight distance decreases, thus degrading the shot feel. In the golf ball -of the present invention, the solid core has a deformation amount, when applying a load of from 10 kgf to 130 kgf, of 2.5 to 10 mm, preferably 2.8 to 8 mm. When the deformation amount is smaller than 2.5, the spin amount increases and the flight distance decreases, thus degrading the shot feel. On the other hand, when the deformation amount is larger than 10, the resulting golf ball is too soft. Therefore, the rebound characteristics of the resulting golf ball are degraded.

The intermediate cover and outer cover will be explained together, because the both covers are formed from the same material. Both covers are formed from a an thermoplastic resin, particularly an ionomer resin which is known in the art and has been used for the cover of golf balls. The ionomer resin used in the present invention is not limited, but includes a copolymer of α-olefin and α,β-unsaturated carboxylic acid having 3 to 8 carbon atoms, of which a portion of the carboxylic acid groups is neutralized with a metal ion, or mixtures thereof. The α-olefin in the ionomer is preferably ethylene or propylene, and the α,β-unsaturated carboxylic acid is preferably acrylic acid or methacrylic acid. The metal ion which neutralizes a portion of carboxylic acid groups of the copolymer includes an alkaline metal ion, such as a sodium ion, a potassium ion, a lithium ion and the like; divalent metal ion, such as a zinc ion, a calcium ion, magnesium ion, and the like; trivalent metal ion, such as an aluminum ion, a neodymium ion, and the like; and the mixture thereof. Preferred are sodium ion, zinc ion, lithium ion and the like, in view of rebound characteristics, durability and the like. The ionomer resin is not limited, but examples thereof will be shown by trade names. Examples of the ionomer resin, which is commercially available from Mitsui Du Pont Polychemical Co., include Hi-milan 1557, Hi-milan 1605, Hi-milan 1652, Hi-milan 1705, Hi-milan 1706, Hi-milan 1707, Hi-milan 1855 and Hi-milan 1856. Examples of the ionomer resin, which is commercially available from Exxon Chemical Co., include Iotek 7010, Iotek 8000, and the like. Examples of the ionomer resin, which is commercially available from Du Pont Co., include Surlyn AD8511, Surlyn AD8512 and the like. These ionomer resins are used alone or in combination.

As the materials used in both the intermediate cover and outer cover of the present invention, the above ionomer resin may be used alone, but the ionomer resin may be suitably used in combination with a specific elastomer or resin. Examples of the combinations thereof include:

(a) a heat mixture of an ionomer resin, an acid-modified thermoplastic elastomer or thermoplastic elastomer having terminal OH groups, and an SBS (styrene-butadiene-styrene) block copolymer having polybutadiene portion with epoxy groups or SIS (styrene-isoprene-styrene) block copolymer having polyisoprene portion with epoxy groups, (b) a heat mixture of an ionomer and a terpolymer of ethylene-unsaturated carboxylic acid ester-unsaturated carboxylic acid, (c) a heat mixture of an ionomer, a maleic anhydride-modified thermoplastic elastomer and a glycidyl group-modified thermoplastic elastomer (d) a heat mixture of an ionomer and a polyamide thermoplastic elastomer. The intermediate cover and outer cover both preferably have a Shore D hardness of 40 to 80. When the Shore D hardness is smaller than 40, the resulting golf ball is too soft, and thus rebound characteristics are degraded. On the other hand, when the Shore D hardness is larger than 80, the resulting golf ball too hard, and thus shot feel is degraded.

In the golf ball of the present invention, the resin composition for the both covers may optionally contain fillers such as barium sulfate, etc., pigments such as titanium dioxide, etc., and the other additives such as a dispersant, an antioxidant, a UV absorber, a photostabilizer and a fluorescent agent or a fluorescent brightener, etc., in addition to the resin component, as long as the addition of the additives does not deteriorate the desired performance of the golf ball cover the amount of the pigment is preferably from 2 to 6 parts by weight based on 100 parts by weight of the cover resin. However, pigments or other additives are seldom used in the intermediate cover.

The covers of the present invention may be formed by conventional methods which have been known to the art and used for the cover of the golf balls. For example, the intermediate cover composition may be preliminarily molded in semi-spherical half-shells, encapsuling the solid core with the two half-shells, followed by press-molding in the mold at 130 to 170° C. for 1 to 5 minutes, or the intermediate cover composition may be directly injection-molded on the solid core. The intermediate cover may have a thickness of 0.5 to 5.0 mm, preferably 0.5 to 3.0 mm. When the thickness of the intermediate cover is smaller than 0.5 mm, the rebound characteristics of the resulting golf ball are degraded. On the other hand, when the thickness is larger than 5.0 mm, shot feel is degraded. A diameter after covering with the intermediate cover may preferably be 30 to 38 mm. When the diameter after covering with the intermediate cover is smaller than 30 mm, the spin amount when hitting increases and flight performance is degraded. On the other hand, when the diameter is larger than 38 mm, the thread rubber layer is too thin to exhibit sufficient rebound characteristics and impact relaxation when hitting. Therefore, flight distance reduces.

The thread rubber layer disposal on the intermediate cover can be the same one as that which has been conventionally used in the thread rubber layer of the thread wound golf balls. For example, the thread rubber can be one that is obtained by vulcanizing a rubber composition prepared by formulating sulfur, a vulcanization accelerator, a vulcanization aid, an antioxidant and the like to a natural rubber or a blend rubber of the natural rubber and a synthetic polyisoprene. The thread rubber is wound on the intermediate cover by conventional methods which have used for the thread wound core of the thread wound golf balls. The thread rubber layer preferably has a thickness of 1 to 5 mm, more preferably 1 to 3 mm. When the thickness of the thread rubber layer is smaller than 1 mm, the thread rubber layer is too thin to exhibit sufficient impact relaxation. Therefore, shot feel is poor. On the other hand, when the thickness is larger than 5 mm, the spin amount when hitting increases and flight performance is degraded.

The outer cover can be formed by the same methods as explained above for the intermediate cover. At the time of the outer cover molding, many depressions called "dimples" may be optionally formed on the surface of the golf ball. Furthermore, paint finishing or stamp marking may be optionally provided after molding the cover for commercial purpose. The outer cover preferably has a thickness of 0.5 to 3 mm, more preferably 1 to 2.5 mm. When the thickness of the outer cover is smaller than 0.5 mm, the cover is too thin. Therefore, the cover is easy to break when repeatedly hit with a club. On the other hand, when the thickness is larger than 3 mm, shot feel is poor.

The total thickness of the covers (intermediate cover/thread rubber layer/outer cover) is preferably 3 to 10 mm, more preferably 4 to 9.5 mm. When the total thickness is smaller than 3 mm, the hardness of the resulting golf ball is too small, and thus the coefficient of restitution is small. On the other hand, when the total thickness is larger than 10 mm, the hardness of the resulting golf ball is too large, and thus controllability at approach shot and shot feel are degraded.

EXAMPLES

The following Examples and Comparative Examples further illustrate the present invention in detail but are not to be construed to limit the scope of the present invention.

Production of solid cores

Each solid core having a diameter of 22 to 34 mm was prepared by mixing the rubber composition for solid core described in Table 1 and press-molding the mixture at 165° C. for 20 minutes. A weight of the resulting golf ball was adjusted to a proper weight by adding barium sulfate.

TABLE 1

| Kind | Amount (parts by weight) |
|---|---|
| BR 11*1 | 100 |
| Zinc acrylate | 20 |
| Dicumyl peroxide | 1.5 |
| Zinc oxide | 15 |
| Antioxidant*2 | 0.5 |
| Barium sulfate | a proper amount |

*1Polybutadiene (trade name "BR 11") from Japan Synthetic Rubber Co., Ltd.
*2Antioxidant (trade name "Noclac NS-6") 2,5-di-t-butylhydroquinone from Ouchi Shinko Kagaku Kogyo Co., Ltd.

Preparation of intermediate cover compositions

The formulation materials shown in Table 2 were mixed using a kneading type twin-screw extruder to obtain pelletized intermediate cover compositions. The Shore D hardness and flexural modulus of the intermediate cover compositions were also shown in Table 2. The extrusion condition were;

a screw diameter of 45 mm, a screw speed of 200 rpm, and a screw L/D of 35.

The formulation materials were heated at 200 to. 260° C. at the die position of the extruder. The flexural modulus was determined according to ASTM D-747, using a sample of a heat and press molded sheet having a thickness of about 2 mm from the each composition, which had been stored at 23° C. for 2 weeks. The Shore D hardness was determined according to ASTM D-2240, using a sample of a stack of the three or more sheets described above.

TABLE 2

| Kind | A | B | C | D | E |
|---|---|---|---|---|---|
| Hi-milan 1605*3 | — | — | 50 | — | — |
| Hi-milan 1706*4 | — | — | 50 | — | 80 |
| Hi-milan 1855*5 | 20 | — | — | — | — |
| Surlyn AD8511*6 | 25 | 25 | — | — | — |
| Surlyn AD8512*7 | 25 | 25 | — | — | — |
| Taftek Z514*8 | 20 | — | — | — | — |
| Bondine AX8390*9 | 10 | — | — | — | — |
| ESBS AT015*10 | — | 15 | — | — | — |
| HG-252*11 | — | 35 | — | — | — |
| IOTEK 8000*12 | — | — | — | 60 | — |
| IOTEK 7010*13 | — | — | — | 40 | — |
| Grilax R-6500*14 | — | — | — | — | 20 |
| Barium sulfate | 4 | 4 | 4 | 4 | 4 |
| Shore D hardness | 54 | 52 | 63 | 66 | 70 |
| Flexural modulus (MPa) | 135 | 90 | 330 | 390 | 560 |

*3Hi-milan 1605 (trade name), ethylene-methacrylic acid copolymer ionomer resin obtained by neutralizing with sodium ion, manufactured by Mitsui Du Pont Polychemical Co., Ltd., MI = 2.8, flexural modulus = about 310 MPa
*4Hi-milan 1706 (trade name), ethylene-methacrylic acid copolymer ionomer resin obtained by neutralizing with zinc ion, manufactured by Mitsui Du Pont Polychemical Co., Ltd., MI = 0.8, flexural modulus = about 260 MPa
*5Hi-milan 1855 (trade name), ethylene-butyl acrylate-methacrylic acid terpolymer ionomer resin obtained by neutralizing with zinc ion, manufactured by Mitsui Du Pont Polychemical Co., Ltd., MI = 1.0, flexural modulus = about 90 MPa
*6Surlyn AD8511 (trade name), ethylene-methacrylic acid copolymer ionomer resin obtained by neutralizing with zinc ion, manufactured by Du Pont Co., MI = 3.4, flexural modulus = about 220 MPa
*7Surlyn AD8512 (trade name), ethylene-methacrylic acid copolymer ionomer resin obtained by neutralizing with sodium ion, manufactured by Du Pont Co., MI = flexural modulus = about 280 MPa
*8Taftek Z514 (trade name), glycidyl methacrylate adduct of hydrogenated styrene-butadiene-styrene block copolymer, manufactured by Asahi Kasei Kogyo Co., Ltd., JIS-A hardness = 65, content of styrene = about 20% by weight, content of hydrogenated butadiene = about 80% by weight; content of glycidyl methacrylate = about 1% by weight
*9Bondine AX8390 (trade name), ethylene-ethyl acrylate-maleic anhydride terpolymer resin, manufactured by Sumitomo Chemical Industries Co., Ltd.1 MI = 7.0, Shore D hardness = 14, content of ethyl acrylate + maleic anhydride = 32% (content of maleic anhydride = 1–4%)
*10ESB AT015 (trade name), styrene-butadiene-styrene structure block copolymer having a polybutadiene block with epoxy groups, manufactured by Daicel Chemical Industries, Ltd., styrene/butadiene (weight ratio) = 40/60, JIS-A hardness = 67, content of epoxy = about 1.5–1.7% by weight
*11HG-252 (trade name), hydrogenated styrene-isoprene-styrene block copolymer having a terminal OH group, manufactured by Kuraray Co. Ltd., JIS-A hardness = 80, content of styrene = about 40% by weight
*12Iotek 8000 (trade name), ethylene-acrylic acid copolymer ionomer resin obtained by neutralizing with sodium ion, manufactured by Exxon Chemical Co., MI = 0.8, flexural modulus = about 370 MPa
*13Iotek 7010 (trade name), ethylene-acrylic acid copolymer ionomer resin obtained by neutralizing with zinc ion, manufactured by Exxon Chemical Co., MI = 0.8, flexural modulus = about 160 MPa
*14Grilax R-6500 (trade name), polyamide elastomer, manufactured by Dainippon Ink & Chemical Industries, Ltd.

Formation of thread rubber layers

Each intermediate cover was formed on the above solid core by injection molding the composition for intermediate cover. Each thread rubber layer was then formed on the intermediate cover by winding the thread rubber. The thread rubber was prepared from a blend of natural rubber and a low cis-isoprene rubber ("Shell IR-309" available from Shell Chemical Co., Ltd.) =50/50 (weight ratio). A diameter after winding the thread rubber was about 39.0 mm.

(Examples 1 to 4 and Comparative Examples 1 to 5)

The outer cover compositions described in Table 3 were preliminary molded into semi-spherical half-shells, encapsuling the resulting thread wound core with the two half-shells, followed by press-molding in the mold for golf ball and then coating with a paint to obtain a thread wound golf ball having an outer diameter of 42.8 mm. Flight performance (initial velocity, launch angle, spin amount and carry) and shot feel were measured or evaluated, and the results are shown in Table 4 (Examples), Table 5 and 6 (Comparative Examples). The test methods are as follows.

TABLE 3

| Kind | a | b | c | d |
|---|---|---|---|---|
| Hi-milan 1605*3 | — | — | 50 | — |
| Hi-milan 1706*4 | — | — | 50 | — |
| Hi-milan 1855*5 | 20 | — | — | — |
| Surlyn AD8511*6 | 25 | 25 | — | — |
| Surlyn AD8512*7 | 25 | 25 | — | — |
| Taftek Z514*8 | 20 | — | — | — |
| Bondine AX8390*9 | 10 | — | — | — |
| ESBS AT015*10 | — | 15 | — | — |
| HG-252*11 | — | 35 | — | — |
| IOTEK 8000*12 | — | — | — | 60 |
| IOTEK 7010*13 | — | — | — | 40 |
| Grilax R-6500*14 | — | — | — | — |
| Barium sulfate | 2 | 2 | 2 | 2 |
| Titanium dioxide | 2 | 2 | 2 | 2 |
| Shore D hardness | 54 | 52 | 63 | 66 |
| Flexural modulus (MPa) | 135 | 90 | 330 | 390 |

Test method (1) Flight performance

After a No. 1 wood club (W#1) was mounted to a swing robot manufactured by True Temper Co. and a golf ball was hit at head speeds of 45 m/sec and 35 m/sec, the initial velocity, launch angle, spin amount and flight distance were measured. The spin amount was measured by continuously taking a photograph of a mark provided on the hit golf ball using a high-speed camera. As the flight distances, carry which was a distance to the dropping point of the hit golf ball was measured.

(2) Shot feel

The shot feel of the golf ball is evaluated by 10 top professional golfers according to a practical hitting test using a No. 1 wood club. The evaluation criteria are as follows. The results shown in the Tables below are based on the fact that not less than 8 out of 10 professional golfers evaluated with the same criterion.

Evaluation criteria:

o: Soft and good x: Hard and poor

TABLE 4

| Example No. | 1 | 2 | 3 | 4 |
|---|---|---|---|---|
| Solid core Diameter (mm) | 24 | 29 | 30 | 34 |
| Intermediate cover | | | | |
| Formulation | C | D | E | B |
| Thickness (mm) | 4 | 2 | 2 | 1 |
| Diameter (mm)*15 | 32 | 33 | 34 | 36 |
| Outer cover | | | | |
| Formulation | c | b | a | d |
| Thickness (mm) | 1.9 | 1.9 | 1.9 | 1.5 |
| Total thickness of cover (mm) | 9.4 | 6.9 | 6.4 | 4.4 |
| Golf ball Diameter (mm) | 42.8 | 42.8 | 42.8 | 42.8 |
| Flight performance (W#1, 45 m/s) | | | | |
| Initial velocity (m/s) | 64.9 | 64.7 | 64.8 | 64.7 |
| Launch angle (°) | 12.20 | 12.25 | 12.33 | 12.30 |
| Spin amount (rpm) | 2700 | 2650 | 2550 | 2580 |
| Carry (yard) | 226.5 | 226.2 | 227.3 | 227.0 |
| Flight performance (W#1) (W#1, 35 m/s) | | | | |
| Initial velocity (m/s) | 51.3 | 51.1 | 51.3 | 51.2 |
| Launch angle (°) | 13.25 | 13.30 | 13.45 | 13.40 |
| Spin amount (rpm) | 2450 | 2330 | 2280 | 2300 |
| Carry (yard) | 170.5 | 170.0 | 171.8 | 171.0 |
| Shot feel | o | o | o | o |

TABLE 5

| Comparative Example No. | 1 | 2 | 3 |
|---|---|---|---|
| Solid core Diameter (mm) | 34 | 34 | 24 |
| Intermediate cover | | | |
| Formulation | — | B | D |
| Thickness (mm) | 0 | 0.4 | 5.5 |
| Diameter (mm)*15 | 34 | 34.8 | 35 |
| Outer cover | | | |
| Formulation | b | d | c |
| Thickness (mm) | 2.1 | 1.5 | 2.3 |
| Total thickness of cover (mm) | | 4.4 | 9.4 |
| Golf ball Diameter (mm) | 42.8 | 42.8 | 42.8 |
| Flight performance (W#1, 45 m/s) | | | |
| Initial velocity (m/s) | 64.3 | 64.4 | 64.7 |
| Launch angle (°) | 12.10 | 12.15 | 12.20 |
| Spin amount (rpm) | 2750 | 2700 | 2650 |
| Carry (yard) | 223.0 | 224.0 | 226.5 |
| Flight performance (W#1, 35 m/s) | | | |
| Initial velocity (m/s) | 49.8 | 50.3 | 51.2 |
| Launch angle (°) | 13.05 | 12.95 | 13.10 |
| Spin amount (rpm) | 2600 | 2530 | 2480 |
| Carry (yard) | 163.5 | 164.2 | 169.5 |
| Shot feel | o | o | x |

TABLE 6

| Comparative Example No. | 4 | 5 | 6*16 |
|---|---|---|---|
| Solid core Diameter (mm) | 22 | 34 | — |

TABLE 6-continued

| Comparative Example No. | 4 | 5 | 6*16 |
|---|---|---|---|
| Intermediate cover | | | |
| Formulation | D | D | — |
| Thickness (mm) | 3.0 | 2.25 | — |
| Diameter (mm)*15 | 28 | 38.5 | — |
| Outer cover | | | |
| Formulation | c | c | — |
| Thickness (mm) | 3.0 | 1.5 | — |
| Total thickness of cover (mm) | 10.4 | 4.4 | 2.3 |
| Golf ball Diameter (mm) | 42.8 | 42.8 | 42.8 |
| Flight performance (W#1, 45 m/s) | | | |
| Initial velocity (m/s) | 64.8 | 64.1 | 64.6 |
| Launch angle (°) | 11.20 | 12.35 | 12.30 |
| Spin amount (rpm) | 3300 | 2500 | 2400 |
| Carry (yard) | 223.5 | 222.5 | 224.5 |
| Flight performance (W#1, 35 m/s) | | | |
| Initial velocity (m/s) | 51.0 | 50.0 | 50.5 |
| Launch angle (°) | 12.25 | 13.42 | 13.35 |
| Spin amount (rpm) | 3050 | 2300 | 2250 |
| Carry (yard) | 161.0 | 160.3 | 167.0 |
| Shot feel | ○ | x | x |

*15Diameter after covering the solid core with the intermediate cover
*16Two-piece solid golf ball, manufactured by Sumitomo Rubber Industries, Ltd.

As is apparent from Table 4 to Table 6, the golf balls of Examples 1 to 4 had the same higher flight distance as the conventional two-piece golf balls, and soft and good shot feel as evaluated by top professional golfers.

On the contrary, in the golf ball of Comparative Example 1, the initial velocity and the flight distance are smaller than that of the golf balls of Examples 1 to 4, because it has the structure of conventional thread wound golf balls and thus has no intermediate cover. The golf ball of Comparative Example 2 has a smaller flight distance than the golf balls of Examples 1 to 4, because the thickness of the intermediate cover is too thin to sufficiently exhibit its desired effect. On the other hand, the golf ball of Comparative Example 3 has a large flight distance but a hard and poor shot feel, because the thickness of the intermediate cover is too thick. The golf ball of Comparative Example 4 has a large spin amount causing a blown-up trajectory when hitting, and thus the flight distance is smaller than the golf balls of Examples 1 to 4, because the diameter after covering with the intermediate cover, which is 28 mm, is too small. The golf ball of Comparative Example 5 has small initial velocity and thus it has a small flight distance in comparison with the golf balls of Examples 1 to 4, because the diameter after covering with the intermediate cover, which is 38.5 mm, is too large to exhibit the rebound characteristics of the thread rubber. The golf ball of Comparative Example 6, which is a conventional two-piece golf ball, has excellent flight performance, but has a hard and poor shot feel.

When hitting at lower head speed, a difference in the initial velocity and a difference in the flight distance between the golf balls of the Examples and Comparative Examples is larger.

What is claimed is:

1. A multi-layer structured golf ball comprising (a) a solid core having a diameter of 23 to 37 mm, (b) an intermediate cover having a thickness of 0.5 to 5.0 mm and formed from a thermoplastic resin on the solid core, (c) a thread rubber layer having a thickness of 1.0 to 5.0 mm, formed on the intermediate cover, and (d) an outer cover covering the thread rubber layer, formed from a thermoplastic resin.

2. The multi-layer structured golf ball according to claim 1, wherein the solid core has a surface JIS-C hardness of 30 to 85, and has a deformation amount of 2.5 to 10 mm when applying a load of from 10 kgf to 130 kgf.

3. The multi-layer structured golf ball according to claim 2, wherein the intermediate cover and the outer cover have a Shore D hardness of 40 to 80.

4. The multi-layer structured golf ball according to claim 1, wherein the intermediate cover and the outer cover have a Shore D hardness of 40 to 80.

* * * * *